US006336576B1

(12) United States Patent
Easter

(10) Patent No.: US 6,336,576 B1
(45) Date of Patent: Jan. 8, 2002

(54) FRONT PACK AND BELT SUPPORT ASSEMBLY

(76) Inventor: Michael D. Easter, 840 J St., Penrose, CO (US) 81240

( * ) Notice: Subject to any disclaimer, the term of this patent is extended or adjusted under 35 U.S.C. 154(b) by 0 days.

(21) Appl. No.: 09/124,723

(22) Filed: Jul. 30, 1998

(51) Int. Cl.[7] ..... A45F 4/02; A45F 3/04

(52) U.S. Cl. ..... 224/153; 224/197; 224/199; 224/268; 224/582; 224/646; 224/647; 224/648; 224/652; 224/667; 224/672; 224/913

(58) Field of Search ..... 224/153, 155, 224/581, 582, 583, 185, 191, 197, 199, 200, 627, 645–652, 654, 655, 666, 667, 672, 268, 270, 913, 610; 150/118

(56) References Cited

U.S. PATENT DOCUMENTS

| | | | | | |
|---|---|---|---|---|---|
| 2,474,752 | A | * | 6/1949 | Montgomery | 224/197 X |
| 2,922,465 | A | * | 1/1960 | Johansson et al. | 224/155 |
| 3,062,421 | A | * | 11/1962 | Fleming | 224/199 |
| 3,300,109 | A | * | 1/1967 | Clark | 224/667 |
| 5,497,922 | A | * | 3/1996 | Tate | 224/191 X |
| 5,560,524 | A | * | 10/1996 | Brune | 224/627 X |
| 5,586,703 | A | * | 12/1996 | Radar et al. | 224/645 X |
| 5,603,441 | A | * | 2/1997 | Easter | 224/647 X |
| 5,738,256 | A | * | 4/1998 | Goff et al. | 224/185 |

FOREIGN PATENT DOCUMENTS

| | | | | |
|---|---|---|---|---|
| DE | 108896 | * | 4/1899 | 224/155 |

* cited by examiner

*Primary Examiner*—Gregory M. Vidovich
(74) *Attorney, Agent, or Firm*—Phillip A. Rein

(57) ABSTRACT

A front pack and belt support assembly including 1) a main front pack assembly which can be collapsed and expanded to achieve a large carrying capacity; 2) a shoulder support strap assembly connected to the main front pack assembly and supported on a shoulder portion of a user thereof; 3) a support frame assembly to provide rigid support to the main front pack assembly; 4) an instrument support assembly connected to the support frame assembly having support means thereon to hold a gun, fishing pole, or tripod for ease of resting and conveyance; 5) a side pack and arm support assembly having pivotal side pocket assemblies pivotally movable from a collapsed to an inclined usage position and having arm support means thereon to support an elbow area of a user thereon; 6) a belt support assembly slidably attached and vertically supported to a user's belt member; and 7) an accessories support assembly having a support receiver assembly to receive a tubular member such as a monopod therein. The side pack and arm support assemblies are vertically adjustable to accommodate the elbow areas of users of various heights to achieve a comfortable resting condition to the elbow area for use in utilizing a camera member, binoculars, or holding a gun during a hunting shooting occurrence.

13 Claims, 8 Drawing Sheets

FIG. 4
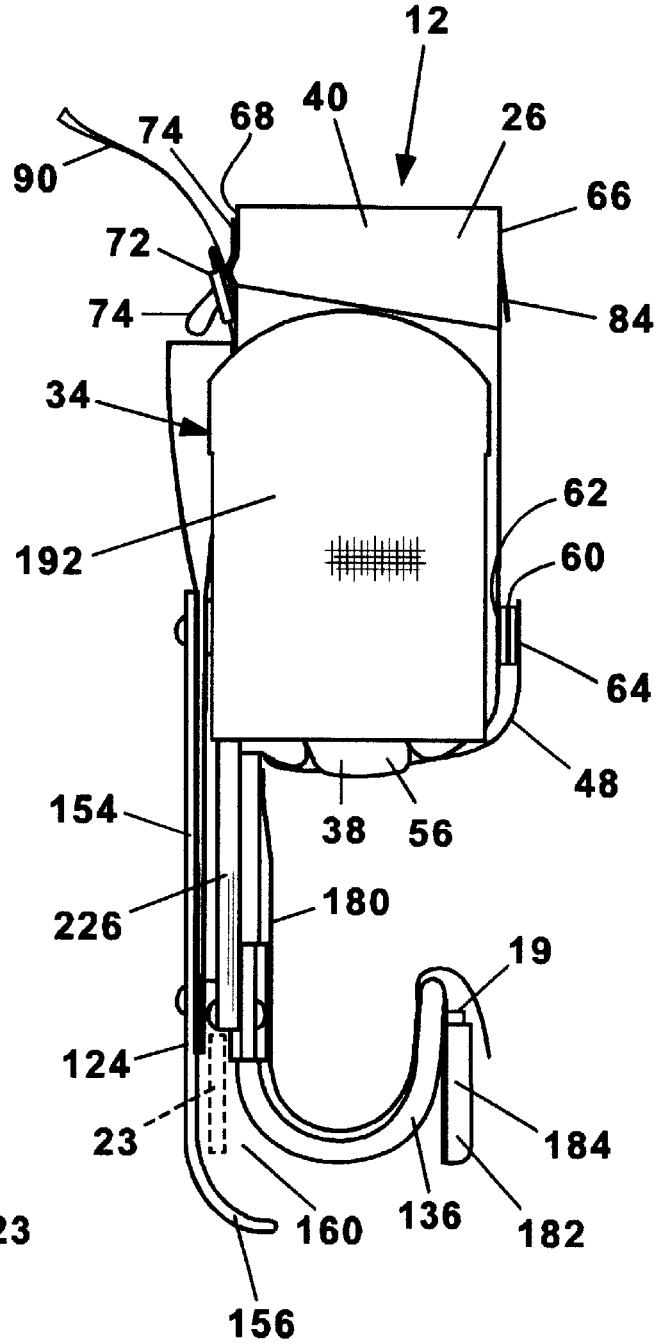
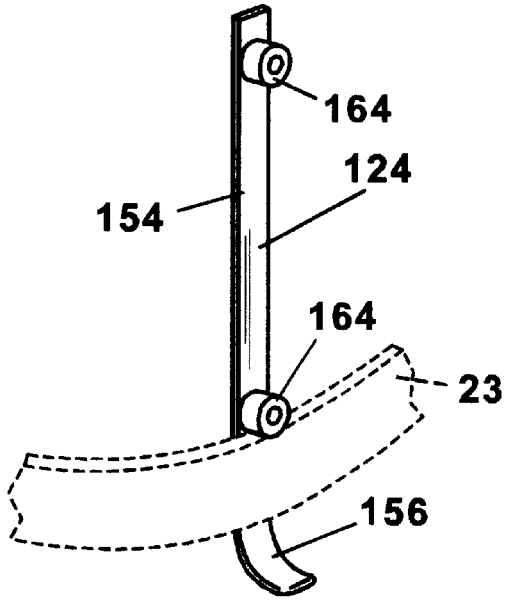
FIG. 4A

FRONT PACK AND BELT SUPPORT ASSEMBLY

PRIOR ART

A patent search was not specifically conducted on this invention. The applicant's own United States patent is deemed the most pertinent.

| U.S. Pat. No. | Invention | Inventor |
|---|---|---|
| 5,603,441 | MULTI-PURPOSE FRONT/BACK PACK APPARATUS | Michael D. Easter |

The Easter patent discloses 1) a front pack assembly having an expandable main pack bag; and 2) a gun and cartridge carrier assembly. Numerous additions and improvements over the applicant's prior art are described and claimed herein

FEATURES OF THE INVENTION

At the present time, there are many people who like to observe, photograph, or hunt wild animals, birds, and other objects with a camera, binoculars, or a gun.

The present invention comprises a multi-function front pack assembly whereby the user can more easily and comfortably hunt, observe, or photograph wildlife and other objects. When compared to the prior art, this new front pack assembly provides significant improvement in several key features. It is more convenient and quiet to operate, while substantially reducing strain and fatigue on the user.

Some of the front pack assembly's weight is held by shoulder straps. A larger portion of the pack weight is placed on the user's waist belt and hips with a new and novel belt support assembly. This new belt support assembly attaches to and detaches from the user's belt without the user ever having to loosen or unbuckle his waist belt.

Another feature of this invention is an adjustable side pack and arm support assembly positioned laterally on either side of the front pack assembly and support frame assembly. When using binoculars, a camera, or a gun, the user can slide his elbow down into the adjustable side pack and arm support assembly for comfortable and effortless use of a camera or gun, even for prolonged periods. Also, these same support assemblies can be used to conveniently mount such instruments as radios, global positioning systems, game finders, flashlights, and such, for continuous viewing and operation by the user. Also, there are removable pockets attached to the adjustable support assemblies for carrying items such as gloves, a knife, or film canisters.

Still, another feature of this invention, that is significantly different from previous prior art packs, is a bag flap enclosure means that is essentially silent and operable with only one hand. A user can easily open or close a bag enclosure flap member without alerting or scaring a bird or animal. Traditional flap fastening methods such as Velcro, snaps, buckles, and zippers are noisy and can require both hands to operate.

An additional feature of this invention is a compass attachment point, on top of a main pack assembly, providing easy and continuous visual reference when the user is traveling in unfamiliar terrain.

Still, another feature of this invention is a support receiver assembly to hold a telescoping monopod for cameras and such. Having a camcorder, or other camera, attached to a vertically adjustable monopod, on the main front pack assembly, allows the user to steadily film for prolonged periods, without fatigue, or store the camera in a convenient position.

Finally, at the bottom of the main front pack assembly near the user's waist, is a U-shaped instrument support assembly. Items such as a long gun or fishing poll can be held and transported within the rack, yet still be readily available for quick use. On the outer side of the U-shaped instrument support assembly is means for storing gun cartridges.

PREFERRED EMBODIMENT OF THE INVENTION

In one preferred embodiment of this invention, a front pack and belt support assembly is provided to be utilized by a user having means thereon to attach to the user's waist; a monopod for support of a camera member; and further includes means for supporting an elbow area of the user for holding and directing the hunting rifle, the camera member, or binoculars for outdoor enjoyment.

The front pack and belt support assembly includes 1) a main front pack assembly; 2) a shoulder support strap assembly connected to the main front pack assembly and operable to be placed for support about the user's torso and shoulder areas; 3) a support frame assembly operable to receive and support the main front pack assembly; and 4) belt support assemblies to provide vertical support against a main belt member on the user; 5) an instrument support assembly connected to the support frame assembly operable to receive and support a rifle, fishing pole, or tripod thereon in a readily accessible position; 6) a side pack and arm support assembly pivotally connected to the support frame assembly and the main front pack assembly; and 7) an accessories support assembly having a support receiver assembly to receive and support a camera monopod or similar structure.

The main front pack assembly includes 1) a collapsible and expandable main pack assembly; 2) a main bag enclosure flap member operable with the collapsible and expandable main pack assembly; 3) a front pocket assembly connected to the collapsible and expandable main pack assembly; 4) adjustable side pocket supports mounted on respective opposite side walls of the collapsible and expandable main pack assembly and operable with the side pack and arm support assembly as will be explained; and 5) a main bag enclosure flap member.

The shoulder support strap assembly has a shoulder strap assembly connected to a torso strap assembly operable to connect the main front pack assembly to the hunter user thereof in a front position.

The shoulder support strap assembly includes frame support straps connected to the support frame assembly and having shoulder pad members to be placed about shoulder areas of the user to provide comfort when carrying a substantial load within the main front pack assembly and/or a load in a large back pack.

The support frame assembly includes 1) a main support frame member; 2) a main frame cover assembly mounted about the main support frame member; 3) the main belt support assemblies connected to the main support frame member with portions slidably engageable with the main belt member worn by the user; and 4) an anchor and spacer assembly mounted between the main support frame member and the belt support assemblies to provide necessary rigidity and spacing.

The instrument support assembly includes an instrument contact member secured to the main support frame member and having an outer cartridge support assembly. The instrument contact member is preferably constructed of a soft leather or rubbery fabric material so as to 1) restrain lateral movement of the rifle or tripod carried thereon; and 2) prevents scratches or damage to the user's instruments.

The cartridge support assembly includes a cartridge pocket member having, a cartridge support member therein to receive various gun cartridges and being selectively enclosed by a cartridge enclosure member.

The side pack and arm support assembly includes 1) a side support assembly connected to outer respective side walls of the main front pack assembly; 2) an arm support assembly connected to respective ones of the side support assemblies and the main front pack assembly; and 3) pivot support assemblies connected to respective side pack assemblies and the support frame assembly by a frame connector assembly.

Each side pocket assembly includes a removable side pocket member usable with a pocket enclosure flap to carry various and removable selected items therein such as gloves or a knife.

Each arm support assembly includes a flexible fabric support member mounted between the pivot support assembly and an adjacent side wall of the main front pack assembly.

Each pivot support assembly includes an adjustable tube assembly having one end connected to a portion of the arm support assembly and a lower end pivotally connected to a lower portion of the main support frame member.

Each side pack and arm support assembly is operable to be selectively pivotal about the lower end of the adjustable tube assembly and providing means on the respective side arm support assemblies to receive an elbow portion of the user thereof for support steadying the hunting rifle or handgun during a gun firing operation or using the binoculars and/or steadying the camera member during a picture taking operation. The side arm support assemblies also provide means for carrying a radio, telephone, or GPS system in a readily operable or viewable position.

The accessories support assembly is provided with a support receiver assembly connected to a side wall portion of the main front pack assembly having a tube member therein operable to receive a camera monopod, or other similar structures.

OBJECTS OF THE MENTION

One object of this invention is to provide a front pack and belt support assembly having 1) a main front pack assembly with a collapsible and expandable main pack assembly; and 2) a belt support assembly positioned on the back of the front pack assembly and operable to be slidably inserted between the user's belt and body without loosening or unbuckling the belt and to resist upward or downward movement of the front pack during a packing operation.

Another object of this invention is to provide a front pack and belt support assembly having 1) a main front pack assembly to receive and support numerous, items to be conveyed therein; and 2) a side pack and arm support assembly connected to each side of the main front pack assembly which is movable from a first position and pivotal outwardly having thereon an arm support assembly having means to receive and support an elbow portion of a user for 1) grasping a hunting gun and aiming and firing during a hunting operation; and 2) providing an arm rest for steadying a camera or a pair of binoculars during use thereof or, optionally, providing means for carrying a radio or GPS system in a readily viewable position.

One other object of this invention is to provide a front pack and belt support assembly having 1) a main front pack assembly secured by a shoulder support strap assembly to a hunter user thereof so as to be conveyed against a front chest of the hunter user; 2) a support frame assembly to receive and support the main front pack assembly and secure an instrument support assembly to receive and hold a hunting rifle in a horizontal lateral position; 3) a side pack and arm support assembly connected to the support frame assembly and the main front pack assembly and having arm support assemblies which can be movable pivotally to a usage position to readily receive a radio or GPS system for continued operation and viewing, or to support an elbow portion of the user during a hunting rifle firing operation, a camera holding operation, or a binocular holding operation; 4) an accessories support assembly having a support receiver assembly connected to the main front pack assembly and having a tube member to receive and support a camera monopod or used to hold and steady a camera member during a picture taking operation.

A further object of this invention is to provide a front pack and belt support assembly which includes a main front pack assembly to be worn on a front portion of a user that 1) does not have to be removed during seating of the user; 2) provides ready access to the front pack assembly; and 3) includes a collapsible and expandable main pack assembly.

Still, one other object of this invention is to provide a front pack and belt support assembly that has multiple uses such as easily conveyed on a front chest area of a hunter user thereof; providing an instrument support assembly to receive and support a hunter's rifle in a readily accessible position during a hunting operation without strain of the hunter user thereof; economical to manufacture; simple to use; and substantially maintenance free.

Various other objects, advantages, and features of the invention will become apparent to those skilled in the art from the following discussion, taken in conjunction with the accompanying drawings, in which:

FIGURES OF THE INVENTION

FIG. 4 is a side elevational view thereof and fragmentary view of portions of the belt support assembly engaged with the user's belt;

FIG. 4A is a perspective view of a belt support assembly;

Figure 1:
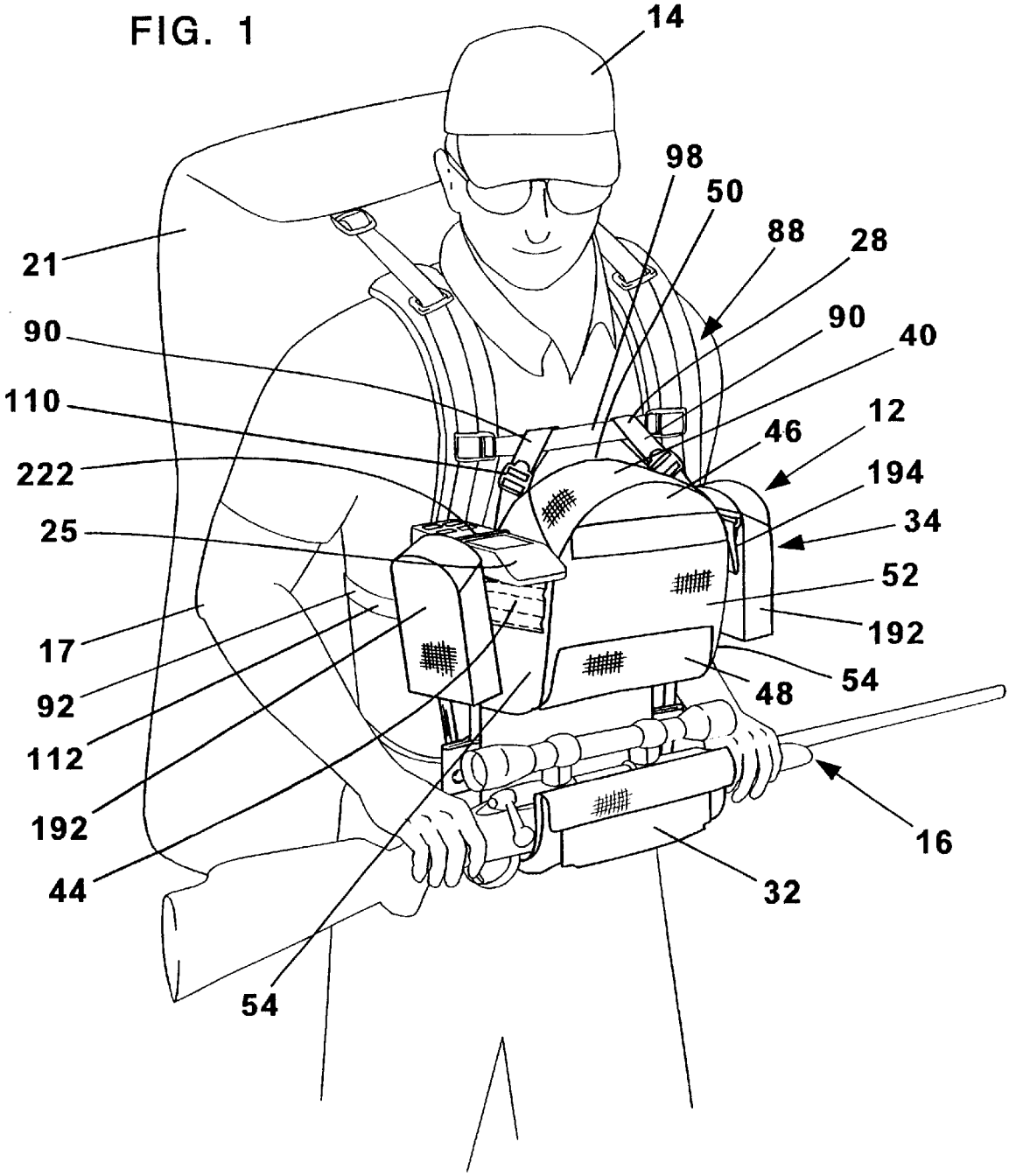
FIG. 1 is a perspective view illustrating the front pack and belt support assembly of this invention shown as supported on waist and shoulder portions of a user holding a hunting rifle and having a large back pack mounted and supported on a back area of the user.

The following is a discussion and description of preferred specific embodiments of the front pack and belt support assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a front pack and belt support assembly of this invention, indicated generally at 12, is shown as mounted on a user 14 shown holding a hunting rifle 16 and carrying a large back. pack 21.

The user 14 is illustrated herein as utilizing a tripod 20, a camera member 18, a compass member 22, and/or a satellite GPS locator 25 as will be explained in detail.

As noted in FIG. 2, the user 14 is wearing a main belt member 23 to which the front pack and belt support assembly 12 is supported thereon and having elbow areas 17 of the user 14 to be readily supported on arm support assemblies during various usage operations as will be explained.

Figure 3:
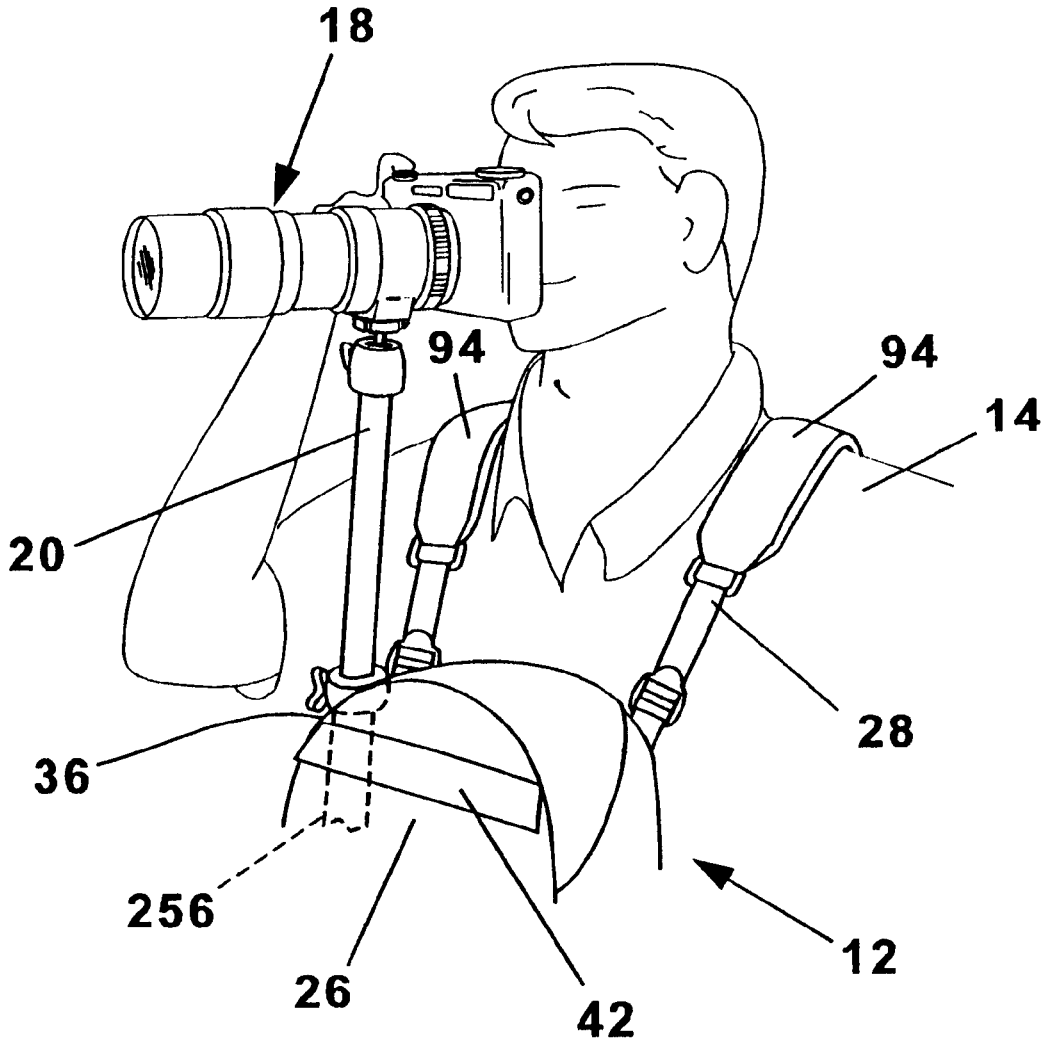
FIG. 3 is a fragmentary perspective view of the front pack and firearm holding assembly similar to FIG. 1 with elements of the large back pack removed showing the user utilizing a monopod member to hold and steady a camera member thereon.

As shown in FIG. 3, the user 14 is utilizing the camera member 18 being supported on the camera support monopod 20 for steady use in taking pictures utilizing the novel features of the front pack and belt support assembly 12 of this invention.

The front pack and belt support assembly 12 includes 1) a main front pack assembly 26; 2) a shoulder support strap assembly 28 connected to the main front pack assembly 26 and releasably connectable to the shoulder and torso area on the user 14; 3) a support frame assembly 30 connected to the main front pack assembly 26; 4) an instrument support assembly 32 connected to a portion of the support frame assembly 30 and operable to receive, support, and convey a hunting rifle 16 thereon in a horizontal position; 5) a side pack and arm support assembly 34 connected to respective opposed side walls of the main front pack assembly 26; and 6) an accessories support assembly 36 connected to the main front pack assembly 26 and operable to receive and support the monopod 20 therein for usage as will be explained.

The main front pack assembly 26 includes 1) a collapsible and expandable main pack assembly 38; 2) a main bag enclosure flap member 40 connected to the collapsible and expandable main pack assembly 38, 3) a front pack assembly 42 secured to a front area of the collapsible and expandable main pack assembly 38,; and 4) an adjustable side pack support 44 connected to respective outer side walls of the collapsible and expandable main pack assembly 38.

The collapsible and expandable main pack assembly 38 includes a main pack assembly 46 having a back wall 50; a front wall 52; opposed sidewalls 54; an expandable section 56; an entrance opening into the main pack assembly 46; and an expandable bag flap member 48, held in an enclosed position by a Velcro closure assembly 60. The Velcro closure assembly 60 includes a loop section 62 that engages a hook section 64.

The main bag enclosure flap member 40 has 1) an anchor section 66; 2) an enclosure section 68; 3) a reinforcing rod member 70 to be sewn within a portion of the enclosure section 68; and 4) a compass connector and pull tab strap 74.

The reinforcing rod member 70 provides a stiffness to the enclosure section 68.

Figure 5:
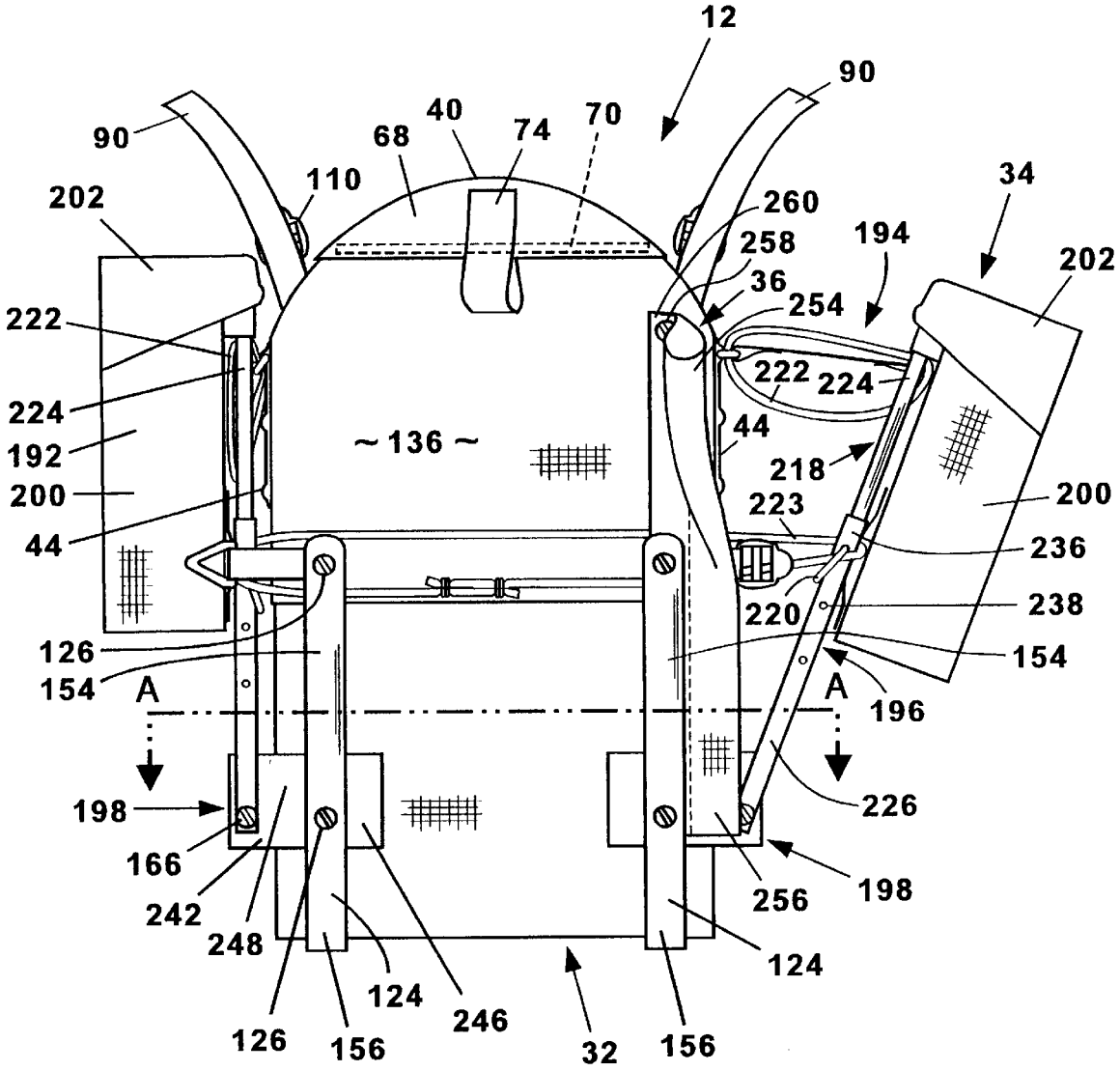
FIG. 5 is a rear elevational view thereof with a side pack and arm assembly shown in an expanded arm support usage condition.

The compass connector and pull tab strap 74 is a loop operable to receive and support the compass member 22 thereon as noted conjointly in FIGS. 4 and 5. The strap 74 also serves as a pull tab for opening and closing the flap member 40.

The front pack assembly 42 provides an auxiliary storage area having 1) a font pack member 82, and 2) a front enclosure member 84 secured to the front pack member 82 to enclose an entrance opening thereto.

The front pack member 82 has a support receiver area therewith to carry various camping supplies and maps as so desired.

Each adjustable side pack support 44 is connected to a respective outer, upper surface of the sidewalls 54 of the main pack assembly 46. Each adjustable side pack support 44 has spaced horizontally extended loop sections 86 which are selectively utilized for connection of a portion of each side pack and arm support assembly 34 thereto so as to be adjustable in height as will be explained.

The shoulder support strap assembly 28 is generally of a conventional nature having 1) a shoulder strap assembly 88 to be placed about the outer shoulder areas of the hunter user 14; 2) frame support straps 90 to clamp the main front pack assembly 26 to a horizontal support strap as noted in FIG. 1; 3) a torso strap assembly 92 mounted about a torso area of the user 14 and connected to portions of the shoulder strap assembly 88; and 4) a pair of shoulder pad members 94 operable to be placed about the shoulder areas of the user 14 to provide cushioning thereto and especially beneficial when carrying the large back pack 21 as noted in FIG. 1.

The shoulder strap assembly 88 includes a pair of spaced shoulder strap members interconnected with an intermediate strap member 98 as noted in FIG. 1. The shoulder strap members are interconnected to the intermediate strap member 98.

Each frame support strap 90 is interconnected to itself by respective buckle members 110.

The torso strap assembly 92 is provided with a strap member 112 having opposite ends thereof interconnected in a conventional manner by an anchor buckle assembly (not shown).

Each shoulder pad member 94 is of a conventional nature having a cushioned main body and connector strap rings 118 to receive the respective shoulder strap members 96 therethrough.

Figure 8:
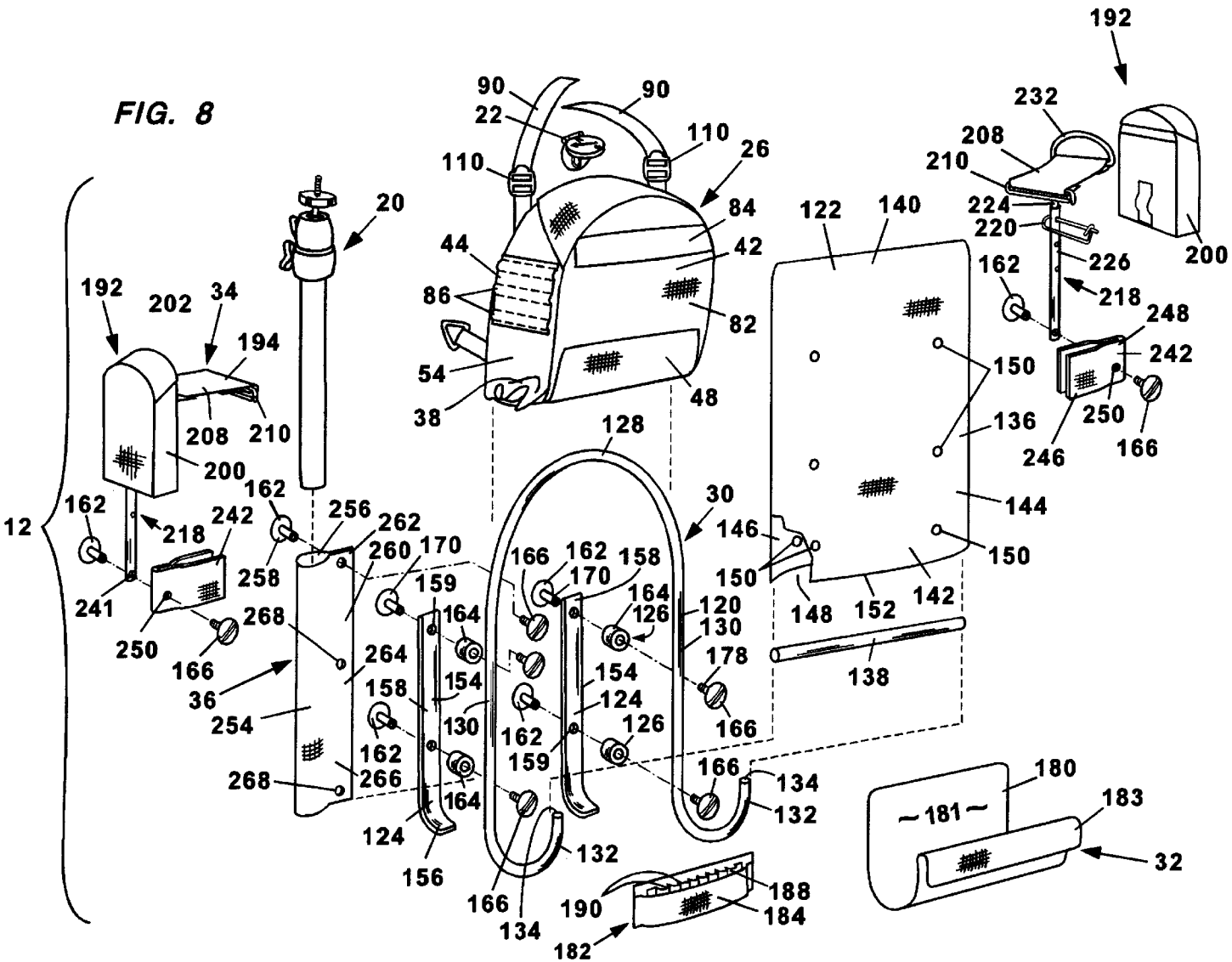
FIG. 8 is an exploded perspective view of the front pack and belt support assembly of this invention.

As best shown in FIG. 8, the support frame assembly 30 includes 1) a main support frame member 120 constructed of a metal tubular material; 2) a main frame cover assembly 122 to be placed over and enclose the main support frame member 120; 3) belt support assemblies 124 operable to be connected to the main support frame member 120; and 4) a plurality of anchor and spacer assemblies 126 mounted between the belt support assemblies 124 and the main support frame member 120.

The main support frame member 120 is provided with an arcuate top section 128 integral at opposite ends thereof with a parallel side sections 130 which, in turn, are integral at outer ends with instrument support sections 132 of a generally U-shape. Each instrument support section 132 is provided with an outer end wall 134.

The main frame cover assembly 122 is preferably constructed of a heavy nylon fabric material having a cover member 136 similar to a pillow case and having an outer end which is sewn to enclose a stiffener rod member 138.

The cover member 136 has 1) an enclosure end section 140; and 2) an open end section 142 with an entrance opening 148 which is enclosed by a sewing seam or anchor seam 152 after mounted about and enclosing the main support frame member 120 as will be noted.

Further, the cover member 136 has a front wall 144 and a back wall 146 having aligned connector holes 150 therethrough for use in anchoring about the main support frame member 120 and to the belt support assemblies 124 as will be explained.

As noted in FIG. 8, the belt support assemblies 124 each include plate support members 154 having outer arcuate end section 156. Each plate support member 154 has a main body 158 with spaced anchor holes 159 therein.

The arcuate end section 156 is operable in conjunction with the main support frame member 120 to form a belt receiver slot or area 160 therebetween to receive the main belt member 23 therebetween as best shown in FIG. 4.

Each anchor and spacer assembly 126 includes a bolt receiver member 162 a spacer member 164, and a bolt member 166. The bolt receiver member 162 is provided with a head section and a support section 170 with internal threads therein to receive the bolt member 166 therein.

The spacer member 164 has a central hole therein to receive the bolt member 166 therethrough.

Each bolt member 166 has a head section and exterior threads 178 to be threaded within the inner threads of the support section 170 of the bolt receiver member 162.

As noted in FIG. 8, a plurality of the bolt receiver members 162 and bolt members 166 are used for interconnection purposes with the enlarged head sections desirable to provide a firm clamping against outer surfaces of the numerous nylon fabric being assembled as noted in FIG. 8.

The instrument support assembly 32 includes 1) an instrument contact member 180 preferably constructed of a rubbery fabric or soft leather material; and 2) a cartridge support assembly 182 to receive and support gun cartridges 19 therein.

The instrument contact member 180 includes a main body 181 having an outer enclosure section 183 acting as a cover flap into access to the cartridge support assembly 182.

The cartridge support assembly 182 includes a cartridge pack member 184 having a cartridge support member 188 therein provided with a plurality of cartridge loop members 190, each to receive and support a respective gun cartridge 19 therein.

The side pack and arm support assembly 34 includes 1) an arm support assembly 194 interconnecting the respective pivot support assemblies 196 with the main front pack assembly 26; and 2) a frame connector assembly 198 to pivotally connect a lower portion of the respective pivot support assemblies 196 to the support frame assembly 30.

Figure 7:
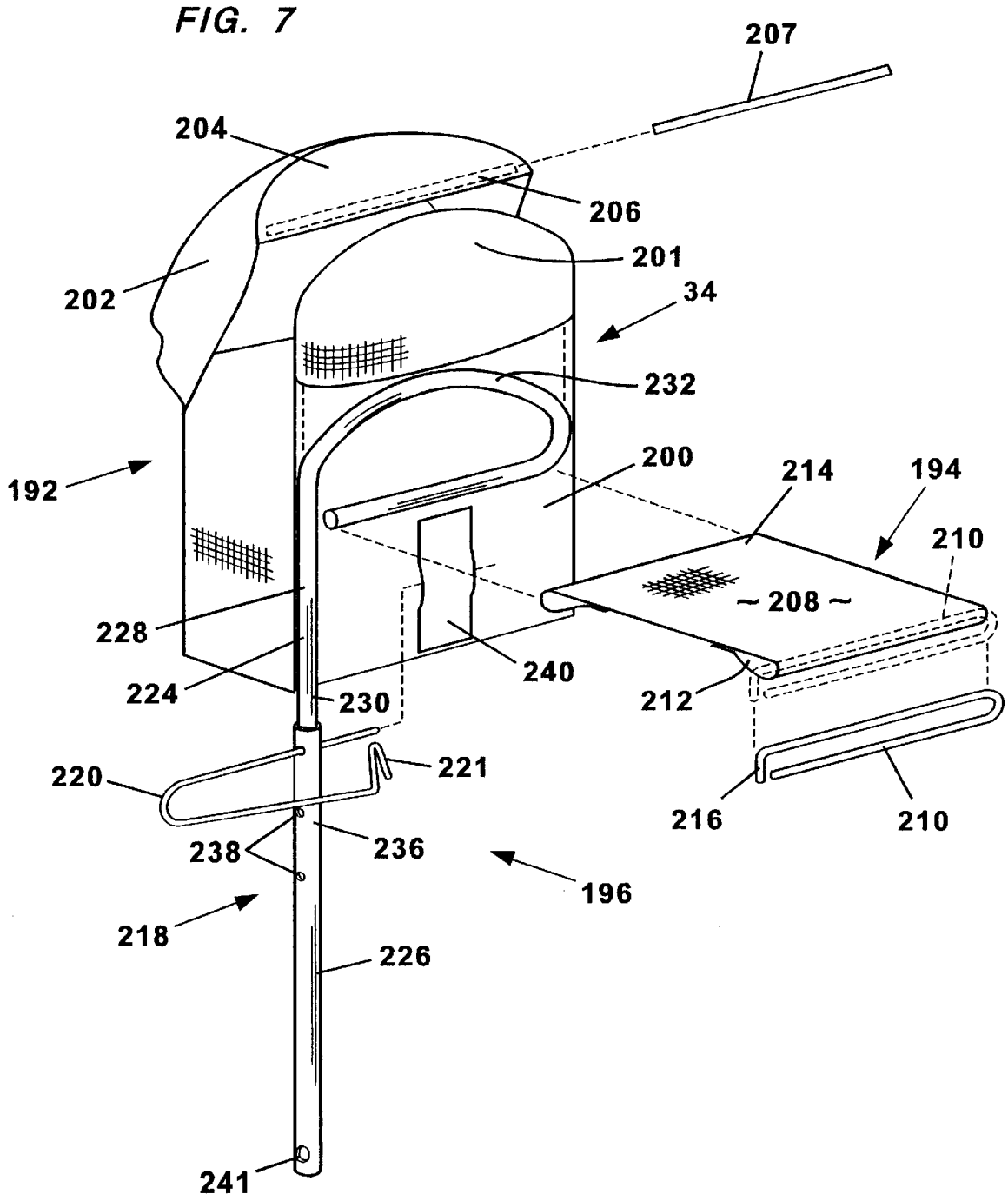
FIG. 7 is an exploded perspective view of the side pack and arm support assembly.

As noted in FIG. 7, each side pocket assembly 192 includes a side pocket member 200 having an enclosure flap 202 connected thereto and operable to reveal and enclose an opening into the side pocket member 200. Each side pocket member 200 is provided with a support pocket section 201 to receive a portion of the pivot support assembly 196 therein as will be explained.

The pocket enclosure flap 202 has an anchor flap member 204 with a rod connector loop section 206 to receive a stiffener rod 207 therein to hold the pocket enclosure flap 202 in the enclosed condition.

As further noted in FIG. 7, the arm support assembly 194 includes a fabric support member 208 interconnected by a connector pin member 210 to the respective adjustable side pack supports 44 on the sidewalls 54 of the main pack assembly 46.

Each fabric support member 208 is provided with an anchor loop section 212 and a pocket connector loop or section 214 as noted in FIG. 7. The first tube or pocket connector section 214 is connected to a portion of the pivot support assembly 196 as will be explained.

The pivot support assembly 196 includes an adjustable tube assembly 218 connected by a pocket connector pin 220 to a connector strap 240 on an inner surface of the respective side pocket members 200. The pocket connector pin 220 has an outer pin closure hook 221 to achieve a locked condition with another portion of the pocket connector pin 220 in a conventional manner.

The adjustable tube assembly 218 includes a first tube member 224 being telescopingly interconnected to a second tube member 226. The first tube member 224 is provided with 1) a mid section 228; 2) an adjustable section 230; and 3) a pocket support section 232 of a oval shape.

The adjustable section 230 is provided with a hole therein for adjustment of an overall length of the adjustable tube assembly 218 as will be explained.

The second tube member 226 has a receiver section 236 to receive the first tube member 224 and provided with a plurality of adjustment holes 238 and a pivot anchor hole 241 at a lower end thereof. The adjustable holes 238 are operable to receive the pocket connector pin 220 therethrough and connected to the connector strap 240 as noted in FIG. 7.

Figure 2:
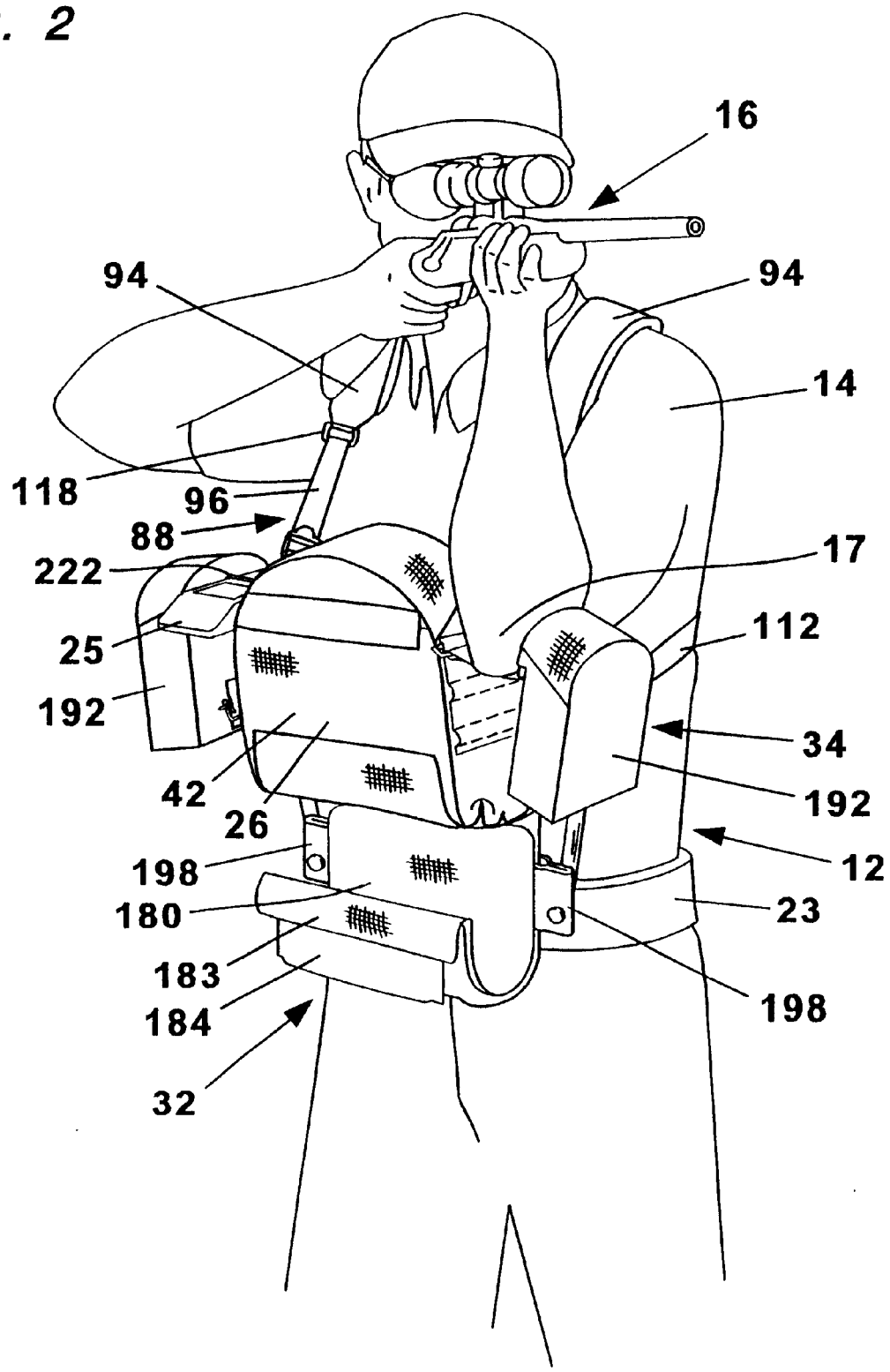
FIG. 2 is a perspective view of the front pack and belt support assembly of this invention similar to FIG. 1 with elements of the large back pack removed illustrating the user holding a hunting rifle in an active aiming and firing position.

An accessories connector strap 222 is provided being an elastic strap so as, to anchor a wireless telephone or the satellite GPS locator 25 as noted in FIGS. 1 and 2.

An elastic bias strap 223, as shown in FIG. 5, is operable to provide a bias force to hold the side pocket assemblies 192 in a vertical position as noted by one of the side pocket assemblies 192 in FIG. 1. The elastic bias strap 223 provides a bias force when one of the side pocket assemblies 192 is being utilized as shown in FIGS. 2 and 5.

Figure 6:
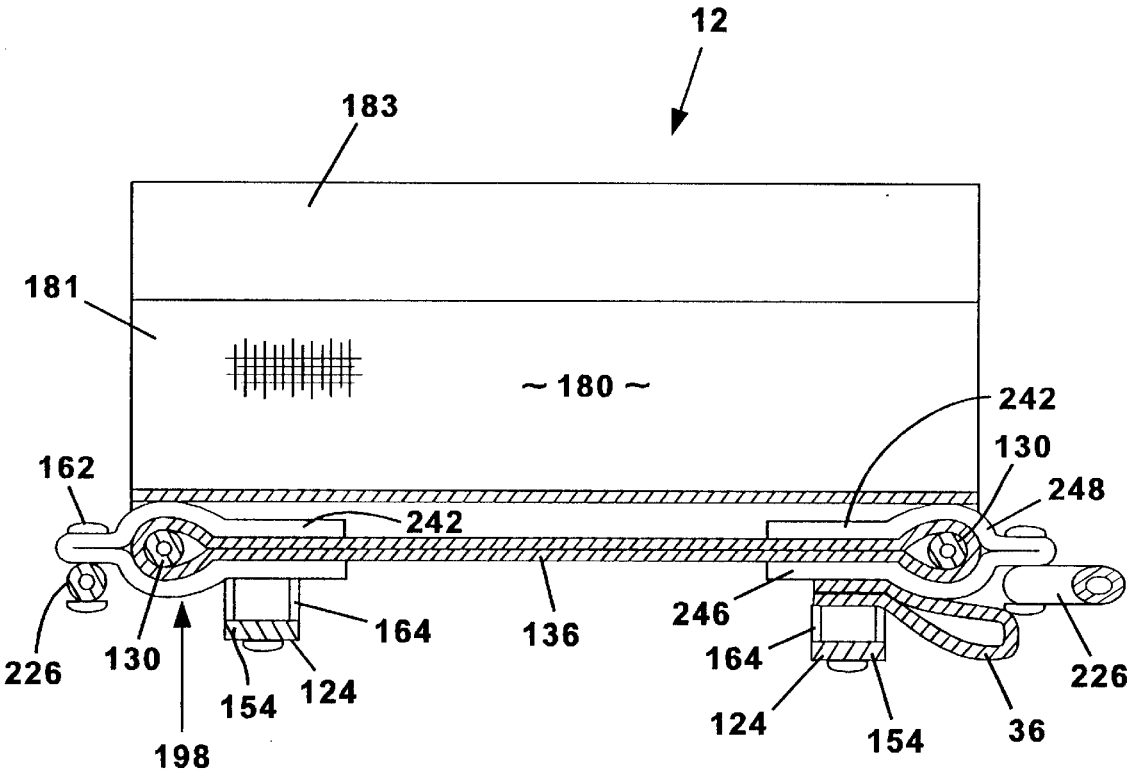
FIG. 6 is an enlarged sectional view taken along line A—A in FIG. 5

As shown in FIG. 6, the frame connector assembly 198 includes a frame connector strap 242 secured to a lower portion of the support frame assembly 30 and the belt support assemblies 124. The frame connector strap 242 includes a clamp section 246 and a tube connector section 248 having a connector hole 250 there in (FIG. 8) for connection by a bolt receiver member 162 and a bolt member 166 to a lower end of the second tube member 226 through the pivot anchor hole 241.

As shown in FIG. 6, the tube connector section 248 is adapted to be clamped about the respective parallel side sections 130 of the U-shaped main support frame member 120.

As shown in FIG. 8, the accessories support assembly 36 includes a support receiver assembly 254 having a tube member 256 secured as by anchor members 258 to the main front pack assembly 26 and a portion of the support frame assembly 30 to add sufficient rigidity thereto.

The anchor members 258 include the bolt receiver 162 and the bolt member 166 which are mounted through respective holes 268 in the tube member 256.

The tube member 256 includes an anchor section 260 having a top portion 262, a mid portion 264, and a lower portion 266, all having the holes 268 therein to receive the respective anchor members 258 therethrough.

The tube member 256 is operable to readily receive the monopod 20 therein for conveyance and support as will be explained.

USE AND OPERATION OF THE INVENTION

In the use and operation of the front pack and belt support assembly 12 of this invention, refer to FIG. 1 whereupon the main front pack assembly 26 by use, of the frame support straps 90 to the shoulder strap assembly 88 is shown as mounted and supported on the shoulder area on the user 14 and placed against a chest area of the user 14 and the belt support assembly 124 is engaged with the user's back pack belt.

In FIG. 1, the user 14 is shown as grasping a hunting rifle 16 which has been placed on and supported by the instrument support assembly 32 in a forward, readily accessible position. The weight of the hunting rifle 16 rests against the instrument contact member 180 and the leather main body 181 so as to provide a soft leather surface for supporting a hunting rifle 16 and prevent damage thereto. Other instruments, such as a camera tripod or fishing pole, are easily supported in the instrument support assembly 32.

In FIG. 1, the user 14 is shown as having a large back pack 21 attached to the front pack and belt support assembly 12 through use of the shoulder support strap assembly 28 and belt support assemblies 124 (FIG. 4).

Further, as noted in FIG. 1, the side pocket assembly 192 and the aide pack and arm support assembly 34 are moved outwardly and having a satellite GPS locator 25 mounted thereon and held in a secure condition by use of the accessory connector strap 222.

As noted in FIG. 2, the other one of the side pocket assemblies 192 of the side pack and arm support assembly 34 has been pivoted outwardly and having an elbow area 17 of the user 14 resting thereon while the hunting rifle 16 has been brought up to eye level of the user 14 during a shooting operation.

The side pocket members 200 can be selectively removed using only the arm support assembly 194 connected to the pivot support assembly 196 and the adjustable side pack support 44.

The elastic bias strap 223 operates to bias both of the side pocket assemblies 192 inwardly and operable to bias and hold in the folded vertical compact position.

As noted in FIG. 3, the monopod 20 is mounted within the tube member 256 of the accessories support assembly 36. In a conventional manner, the camera member 18 has been connected to an upper end of the monopod 20 so that the user 14 can hold steady for a prolonged period of time the camera member 18 thereon while taking desired photographs. The monopod 20 can also be collapsed downwardly to hold the camera member 18 in an out of the way position until the user 14 is ready to take pictures.

It is obvious that the binoculars or the camera member 18 can be readily conveyed within the collapsible and expandable main pack assembly 38. On usage, the capacity of the collapsible and expandable main pack assembly 38 can be doubled from that shown in FIG. 4 on movement of the expandable section 56 downwardly. Further, a map or other accessories can be readily conveyed within the front pack assembly 42 in a conventional manner.

It is obvious that the instrument support assembly 32 includes the cartridge support assembly 182 to receive and enclose a plurality of gun cartridges 19 therein for ease of conveyance and being readily available by the hunter user 14 during a shooting or hunting operation.

It is noted that the arm support assembly 194 of the side pack and arm support assembly 34 has means thereon to telescopingly adjust the first tube member 224 relative to the second tube member 226 on the adjustable tube assembly 218 to adjust the effective height and position of the side pocket assemblies 192. More importantly, this allows proper positioning of the fabric support member 208 on the respective arm support assemblies 194. This is important to achieve a proper height for resting of the elbow area 17 of the user 14 depending on the size and height of the user 14 utilizing same.

This adjustment feature is further provided by use of the adjustable side pack supports 44 having a plurality of the spaced loop sections 86 to receive the respective connector pin members 210 therein.

The adjustable height of the adjustable tube assembly 228 is locked into position by use of the pocket connector pin 220 as noted in FIG. 7.

The front pack and belt support assembly 12 of this invention provides a main pack assembly 46 that is expandable to hold a large quantity of photography or camping supplies; provided with an instrument support assembly 32 to readily receive, protect, and support a tripod, fishing pole, or rifle thereon; provided with side pocket assemblies 192 which can be pivoted outwardly and utilized to support an elbow area of a user thereon; provided with an accessories support assembly 36 to receive and support a tubular monopod thereon to hold a pair of binoculars or a camera member; and provided with an adjustable means thereon to receive and support the elbow area of a user 14 at a proper height and further provides a slidably attached belt support assembly 124.

FIG. 5 shows the main bag enclosure flap member or closure means 40 in the closed and secured position having engulfed the uppermost arcuate portion of the main support frame member 120. The user 14 has only to grasp with thumb and forefinger the lip portion of the enclosure section 68 containing the reinforcing rod member 70 and lift the section up and over the arcuate frame for surprisingly easy, quiet, and one-handed opening and closing. This new pack bag closure means is made possible by combining the elements of a flexible fabric bag, a hood shaped flap containing a rigid cross member, a rigid arched frame, and gravity. FIG. 7 shows this new closure means in an open position.

In FIG. 4, it can be seen that the user's main belt member 23 is securely engaged with the belt support assemblies 124. By tipping the top of the main front pack assembly 26 slightly forward, the arcuate end section 156 of the plate support member 154 is easily slid down between the user's main belt member 23 and his body. Then, the top of the front pack and belt support assembly 12 is pulled back to the chest of the user 14, followed by attachment of the shoulder support strap assembly 28 about the shoulders of the user 14, thereby positioning the pack in a vertical position and rotating the outer arcuate end section 156 down and under the belt member 23 of the user 14 to prevent undue upward movement of the pack. Spacer members 164 prevent downward movement of the pack as it rests on top of the belt member 23 of the user 14.

The front pack and belt support assembly provides a structure that is economical to manufacture; sturdy in construction; easy to use; and substantially maintenance free.

While the invention has been described in conjunction with preferred specific embodiments thereof, it will be understood that this description is intended to illustrate and not to limit the scope of the invention, which is defined by the following claims:

I claim:

1. A front pack and belt support assembly, comprising:

a) a main front pack assembly including a main pack assembly connected to a support frame assembly;

b) said support frame assembly includes a belt support assembly adapted to be engageable with and supported on a main belt member worn by a user;

c) a side pack and arm support assembly having a pivot support assembly connected by an arm support assembly to said main pack assembly;

d) said arm support assembly allows said pivot support assembly to be pivoted selectively from a collapsed condition adjacent said main pack assembly to a lateral position therefrom to receive and support an upper portion of a user's arm thereon while holding a rifle member, binoculars, or a camera member to hold steady during usage thereof;

e) said pivot support assembly having one end connected to a side pocket assembly and a lower end pivotally connected to a frame connector strap secured to said support frame assembly which is connected to said main pack assembly;

f) said pivot support assembly is movable from the collapsed condition to the lateral position and provides substantial vertical support to said arm support assembly so as to readily support the upper portion of the user's arm thereon;

g) said pivot support assembly includes an adjustable tube assembly having a first tube member connected to said arm support assembly and a second tube member telescopingly connected to said first tube member and having a lower anchor portion pivotally connected to said frame connector strap;

h) said first tube member and said second tube member are selectively adjustable relative to each other so as to provide the user's arm support at a proper height relative to the size of the user thereof for supporting the user's arm portion thereon at a proper height; and i) a shoulder support strap assembly connected to said main pack assembly and adapted to be supported on a shoulder area of a user thereof.

2. A front pack and belt support assembly as described in claim 1, wherein:

a) said main front pack assembly includes an adjustable side pack support operable to adjustably receive and support one end of said arm support assembly so as to cooperate with said pivot support assembly to provide the proper height of said arm support assembly depending on the height and size of the user thereof.

3. A front pack support means as described in claim 1, wherein:

a) said main pack assembly includes a main bag enclosure flap member secured to said main pack assembly and selectively engageable over an entrance opening to hold in an enclosed condition; and b) a means for stiffening said main bag enclosure flap member whereby said main pack assembly may be opened or closed about an uppermost arcuate portion of said support frame assembly with a low level of noise being emitted therefrom which is of great benefit in a hunting or wildlife observing operation.

4. A front pack and belt support assembly; comprising;

a) a main front pack assembly including a main pack assembly connected to a support frame assembly; and a shoulder support strap assembly connected to said main pack assembly and adapted to be supported on a shoulder area of a user thereof;

b) said support frame assembly includes a belt support assembly engageable with and supported on a main belt member worn by a user;

c) a side pack and arm support assembly having a pivot support assembly connected by an arm support assembly to said main pack assembly; and d) said arm support assembly allows said pivot support assembly to be pivoted selectively from a collapsed condition adjacent said main pack assembly to a lateral position therefrom to receive and support an upper portion of a user's arm thereon while holding a rifle member, binoculars, or a camera member to hold steady during usage thereof.

5. A front pack and belt support assembly as described in claim 4, wherein:

a) said pivot support assembly having one end connected to said arm support assembly and a lower end pivotally connected to a frame connector strap; and b) said pivot support assembly is movable from the collapsed condition to the lateral position and provides substantial vertical support to said arm support assembly so as to readily support the upper portion of the user's arm thereon.

6. A front pack support means operable to selectively receive a gun, a fishing rod, binoculars, or a camera on a tripod, comprising:

a) a main pack assembly connected to a support frame assembly;

b) a side pack and arm support assembly connected by an arm support assembly to said main pack;

c) said side pack and arm support assembly movable from a first collapsed position adjacent to said main pack assembly to a second expanded condition to receive and support an upper portion of a user's arm thereon;

d) said side pack and arm support assembly includes a pivot support assembly having one end pivotally connected to a side pocket assembly and a lower end pivotally connected to said support frame assembly;

e) said arm support assembly includes a biased member operable to be placed thereabout and to contact and hold accessories adapted to be carried thereon being a cellular telephone, or a locator GPS member; and f) a shoulder support strap assembly connected to said main pack assembly and adapted to be supported on a shoulder area of a user thereof;

whereby the user's arm is supported while holding a camera, binoculars, or a gun, in a user's hands.

7. A front pack support means as described in claim 6, wherein:

a) said main pack assembly includes a main bag enclosure flap member secured to said main pack assembly and selectively engageable over an entrance opening to hold in an enclosed condition; and b) a connector strap connected to said main bag enclosure flap member which supports a compass member connected thereto and allows enclosure of said main pack assembly and opening thereof having a low level of noise emitted therefrom which is of great benefit in a hunting or wildlife observing operation.

8. A front pack support assembly, comprising;

a) a main pack assembly connected to a support frame assembly;

b) a shoulder support strap assembly connected to said main pack assembly and adapted to be supported on a shoulder area of a user thereof;

c) a side pack and arm support assembly connected by an arm support assembly to said main pack;

d) said side pack and arm support assembly movable from a first collapsed position adjacent to said main pack assembly to a second expanded condition to receive and support an upper portion of a users arm thereon; and e) said side pack and arm support assembly includes a bias strap mounted about a pivot support assembly to bias inwardly to hold in the collapsed position and provide a biasing means on moving outwardly to hold in the desired biased condition depending on the size of the user's arm being supported on said arm support assembly.

9. A front pack support assembly as described in claim 8, wherein:

a) a second one of said side pack and arm support assemblies secured to an opposite side of said main pack assembly; and b) said side pack and arm support assemblies each include said pivot support assembly, each said pivot support assembly having telescoping tube members being selectively adjustable in length so as to provide said arm support assemblies at a proper height depending on the height and size of the user's arm thereon.

10. A front pack and belt support assembly supported by a shoulder strap assembly, comprising:

a) a front pack assembly connected to a support frame assembly having a belt support assembly adapted to be mounted on and supported by a user's waist support belt member and a user's hip area;

b) a shoulder support strap assembly connected to said main pack assembly and adapted to be supported on a shoulder area of a user thereof;

c) said belt support assembly includes a support plate member having a main body with an outer arcuate end section adjacent to a belt receiver slot to receive and be supported on the user's waist support belt member;

d) a side pack and arm support assembly having a pivot support assembly connected at one end to a side pocket assembly and a lower end is pivotally connected to a frame connector strap secured to said support frame assembly which is connected to said front pack assembly;

e) said pivot support assembly having first and second tube members telescopingly engaged with each other so as to selectively increase and decrease the overall length thereof to adjust said side pocket assembly vertically; and f) said arm support assembly pivotally connected to said pivot support assembly and a portion of said front pack assembly to achieve adjustable height support variation.

11. A front pack and belt support assembly as described in claim 10, wherein:

a) said side pocket assembly includes a side pocket member with an entrance opening selectively enclosed by an anchor flap member; and b) said anchor flap member having a stiffener rod mounted about a portion of said pivot support assembly to hold in an enclosed position.

12. A front pack and belt support assembly comprising:

a) a main front pack assembly including a main pack assembly connected to a support frame assembly;

b) a shoulder support strap assembly connected to said main front pack assembly and adapted to be supported on a shoulder area of a user thereof;

c) said suport frame assembly includes a belt support assembly adapted to be engageable with and supported on a user's waist belt member;

d) said belt assembly being slideably attachable to the user's closed and fastened waist belt member;

e) a side pack and arm support having a pivot support assembly connected by an arm support assembly to said main pack assembly; and f) said arm support assembly allows said pivot support assembly to be pivoted selectively from a collapsed position adjacent said main pack assembly to an extended position to receive and support an upper portion of a user's arm thereon while holding a rifle member or a camera member in the user's hands.

13. A front pack and belt support assembly as described in claim 12, wherein:

a) said arm support assembly includes a biased member operable to be placed thereabout and to contact and hold accessories to be carried thereon.

* * * * *